United States Patent [19]

Stibal et al.

[11] Patent Number: 4,756,679

[45] Date of Patent: Jul. 12, 1988

[54] APPARATUS FOR COOLING AND CONDITIONING MELT-SPUN MATERIAL

[75] Inventors: W. Stibal, Trimmis; A. Blum, Domat-Ems, both of Switzerland

[73] Assignee: Ems-Inventa AG, Zurich, Switzerland

[21] Appl. No.: 908,040

[22] Filed: Sep. 16, 1986

[30] Foreign Application Priority Data

Sep. 18, 1985 [CH] Switzerland ..... 4054/85

[51] Int. Cl.[4] ..... B29C 47/88

[52] U.S. Cl. ..... 425/72 S; 264/177.13; 264/211.22; 264/237; 425/185; 425/192 S

[58] Field of Search ..... 425/72 S, 185, 186, 425/192 S; 264/168, 236, 188, 204, 207, 177.13

[56] References Cited

U.S. PATENT DOCUMENTS

| | | | |
|---|---|---|---|
| 2,373,078 | 4/1945 | Kleist | 425/94 |
| 2,931,422 | 4/1960 | Long | 425/8 |
| 3,480,709 | 11/1969 | Jacob et al. | 264/168 |
| 3,834,847 | 9/1974 | Fletcher | 425/72 S |
| 3,969,462 | 7/1976 | Stofan | 264/210.8 |
| 3,988,086 | 10/1976 | Marshall et al. | 264/210.8 |
| 4,038,357 | 7/1977 | Boyes et al. | 264/237 |
| 4,285,646 | 8/1981 | Waite | 425/72 S |
| 4,332,764 | 6/1982 | Brayford et al. | 425/72 S |

FOREIGN PATENT DOCUMENTS

| | | | |
|---|---|---|---|
| 52-15615 | 2/1977 | Japan | 264/237 |

*Primary Examiner*—Jay H. Woo
*Assistant Examiner*—C. Scott Bushey
*Attorney, Agent, or Firm*—Jordan B. Bierman

[57] ABSTRACT

A nozzle plate having a plurality of passages is adapted to permit a melt to flow therethrough to form a stream of filaments. A dispersing head is located downstream of the plate and in the filament stream. The head is substantially in the form of a cylinder with its axis substantially parallel to the stream. An inlet for coolant (preferably air) connects a source thereof with the head. The wall of the head is porous, thereby permitting the coolant to pass through the wall and impinge on the filaments.

31 Claims, 1 Drawing Sheet

APPARATUS FOR COOLING AND CONDITIONING MELT-SPUN MATERIAL

The present invention is directed to an apparatus which is capable of cooling melt-spun filaments, as well as conditioning the filaments after they have been cooled.

BACKGROUND OF THE INVENTION

In the melt-spinning process, a stream of molten material is divided into a plurality of filaments, cooled below their solidification point to form the desired product. It is preferable that cooling be effected to a point below the glass transition temperature as well. Once this has been accomplished, the filaments are drawn off and wound in a conventional manner. In order to produce a product of high quality, it is essential that the melt be as homogeneous as possible and the cooling conditons be uniform.

In addition, the homogeneity of the melt is adversely affected by thermal decomposition. There should be no zones in which the melt throughput is slow or stagnant, as these will cause clogging and breakage of filaments. This can be best accomplished by the use of round nozzles, having a plurality of openings therein.

However, these nozzles possess certain disadvantages with regard to cooling of the filaments produced thereby. Often, this has been done by blowing a transverse stream of air across the filaments. In order to accommodate this, it is necessary that the nozzle diameter be very large and the number of openings per plate similarly be quite low. Moreover, the filaments on the near side of the transverse stream are cooled more rapidly and to a greater extent than those on the opposite side. When the number of openings and the throughput thereof is increased, this difference is amplified. This will have an adverse affect on such properties as the uniformity of stretch behaviour, elongation at break, shrinkage, and coloration.

One "solution" to the foregoing is the provision of rectangular nozzles having 2,000 to 3,000 openings therein. These would replace the round nozzles which would have 600 to 800 openings at most. However, rectangular nozzles, because of their shape, have a greater tendency to block the melt stream than do round nozzles. Obviously, those openings near the corners would have a lower throughput than those in the center. This variation is undesirable and, for this reason, rectangular nozzles must be changed far more often than round ones.

Still another approach is to use circular nozzles which are provided with a very large number of radially symmetrical openings. The air stream is not introduced transversely, but rather radially from all sides. U.S. Pat. No. 3,299,469 describes such a process.

However, this, too, presents serious problems. When the air blows inwardly, it tends to compact the filaments, reducing the space between them. In some cases, the filaments actually touch one another and, because they are not yet cool, fusion takes place. On the other hand, if the coolant stream is moving outwardly, the filaments are blown away from one another and there is little or no tendency for them to compact.

Furthermore, when blowing inwardly, the air is heated as it moves to the center of the bundle of fibers. Hence, at that point its effect is sustantially reduced. However, if the flow is in the opposite direction, the coolest air is introduced at the center and warms up as it reaches the periphery of the filaments. However, at this point, the outside air can assist in cooling the material. Thus, the ambient air is useful at the place it is most needed.

Such patents as U.S. Pat. No. 3,858,386; 3,969,462; 4,285,646; and EP Nos. 40,482; and 50,483 broadly teach blowing from the center outwards. However, introduction of the air stream is extremely difficult in such a situation and is undoubtedly the reason that this process has found little acceptance.

If the air stream of the foregoing type is introduced below and flows upwards, the stream crosses the filament path. It is necessary, when using such a device, to divide the exiting filaments into two bundles moving side-by-side. In this way, the freshly-spun filaments are not disturbed by the air stream inlet pipe. Such an process is described in U.S. Pat. No. 4,285,646 (Column 2, line 6 to 68). There are a number of disadvantages to this process. Great difficulties arise when it is necessary to start up the operation after interruptions resulting from, for example, filament breakage, nozzle change, cleaning, etc. The reference makes no mention of dealing with these problems. The fibrils which, at this point, are insufficiently strong, but quite tacky, readily adhere to the air outlet. They then break and other fibrils stick to them and also break. This is such a serious problem, that even skilled personnel have the greatest difficulty in properly regulating such a process.

In order to solve the foregoing problems, such patents as U.S. Pat. No. 4,285,646; EP No. 40,482; and EP No. 50,483 teach introducing the air stream from above centrally through a group of nozzles. However, as in the other cases, the solution brings additional problems. The melt in the nozzle should not be cooled by the air stream, as this assists in causing unwanted blockage. Moreover, the air stream should not be heated by hot nozzles. Hence, it is necessary to isolate one from the other. The only way this can be done is to increase the nozzle diameter to a point at which the round nozzle no longer gives a melt flow which is radially symmetrical.

SUMMARY OF THE INVENTION

It is among the objects of the present invention to provide a cooling apparatus for outward blowing of melt-spun filaments which avoid the above disadvantages.

It is also among the objects of the present invention to provide an apparatus which also is capable of coating the cooled filaments with a suitable liquid; e.g. a conditioning agent.

In accordance with the present invention, such an apparatus comprises a nozzle plate having a plurality of passages adapted to permit the melt to flow therethrough, thereby forming a stream of filaments. A coolant dispersing head is located downstream of the plate and in the stream of filaments. The head is substantially in the form of a cylinder with its axis approximately parallel to the stream. A coolant (preferably air) is introduced through an inlet which connects a source of coolant with the head. The cylindrical wall of the head is porous and the coolant passes outwardly through the wall and impinges on the filaments. It is to be preferred that the passages through the nozzle are arranged concentrically and it is most preferred that they form a plurality of circles.

It is also desirable that the coolant be introduced at the downstream end of the head and travel countercurrently to the stream of filaments. In a preferred form of the device, a circular aperture is provided at the upstream end. There is a tube from the point of connection between the coolant inlet and the head to the upstream end of the head. The tube carries a relatively strong stream of air which rises through the head and exits through the circular aperture adjacent the nozzle plate. It is to be preferred that the aperture be angled outwardly and downstream so that the nozzle plate is not cooled.

There is also provided a spike extending out of the upstream end of the head and which is capable at its downstream end of cooperating with a valve seat on the tube. When the head is initially placed in the newly started filament stream, the strong flow of air out of the top insures that there will be no contact between the head and the cooling filaments. As the head is moved towards the nozzle plate (parallel to the flow of filaments), the spike presses against the nozzle plate which forces the opposite end of the spike against the valve seat, thereby cutting off this flow of air.

Of course, the porous nature of the cylinder wall permits substantial flow of air outwardly along its entire length. Once the spinning operation has begun, this flow is ample to provide the necessary cooling.

It is a feature of the present invention that the head is so mounted that it is capable of being moved into and out of the filament stream; e.g. a direction parallel to the nozzle plate. This can take place by a simple pivot arrangement so that the head moves along a path substantially perpendicular to the direction of flow.

The air inlet is preferably substantially perpendicular to the direction of flow and has a cross-section such that the dimension perpendicular to the direction of flow is relatively narrow, while the dimension parallel to the direction of flow is relatively large. This presents a minimum obstacle to the passage of the filaments. In addition, the upstream edge of the coolant inlet is provided with a ceramic coating or carries a ceramic element (as, for example, a rod or half shell) which acts as a filament deflector. This is to aid in avoiding any disturbance or turbulence which might be caused by division of the filaments.

Since it is commonly desired to coat the filaments with a liquid such as a conditioner, the present invention provides a means for doing so. Downstream of the head is an applicator which comprises a peripheral channel adapted to be contacted by the filaments. A liquid inlet is provided which connects the source of coating liquid with the peripheral channel. Thus, as the filaments are drawn off, they contact the channel and are coated with the liquid. Any overflow runs into a return channel downstream of the applicator which is provided with a liquid return which draws off the excess liquid and conveys it away from the stream.

In the preferred form of the device, both the liquid inlet and the liquid return are located within the coolant inlet.

The material of which the device is constructed is not particularly critical, and is generally well known to those of ordinary skill. For example, the coolant dispersing head may be sintered metal, a filter web, or reinforced filter fleece. Other materials, as would be obvious, may be substituted. In essence, the head should be relatively porous, so that the air will flow through the wall readily.

BRIEF DESCRIPTION OF THE DRAWINGS

In the accompanying drawings, constituting a part hereof and in which like reference characters indicate like parts.

DESCRIPTION OF THE PREFERRED EMBODIMENTS

Figure 1:
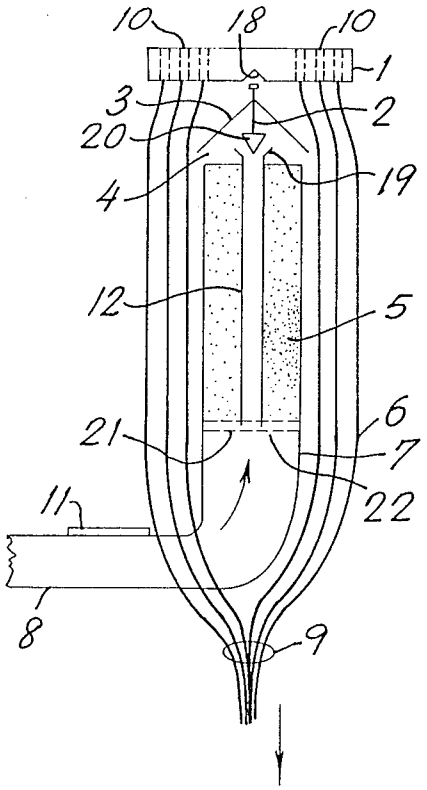
FIG. 1 is a diagrammatic view showing the present invention located in the filament stream.

Nozzle plate 1 is provided with passages 10 for the flow of hot melt. As can particularly be seen in FIG. 1, filaments 6 are spun from nozzle plate 1 and passages 10 and are gathered at filament guide 9. Thereafter, they are twisted and wound in the usual manner.

Placed in the stream of filaments 6 is dispersing head 5. This is generally cylindrical in shape and contains tube 12 which extends from bottom 21 to valve seat 19. Dispersing head 5 is provided with tapered cover 3 which forms circular aperture 4. Center spike 2 is provided with valve closure 20 which is adapted to cooperate with valve seat 19. Nozzle plate 1 carries depression 18 which will receive the upper end of spike 2. Coolant inlet 8 is connected to a source of coolant and, at its other end, is attached to dispersing head 5 at bottom 21. Bottom 21 is provided with a plurality of openings through which the coolant (preferably air) can pass. The side wall of head 5 is provided with pores 13 so that the coolant which passes through openings 22 flows radially outwardly through the wall and impinges on filaments 6.

At the same time, the main force of the coolant passes through tube 12 and exits at valve 19. It then passes through circular aperture 4 and impinges on filaments 6 at the ends thereof adjacent nozzle plate 1.

Figure 4:
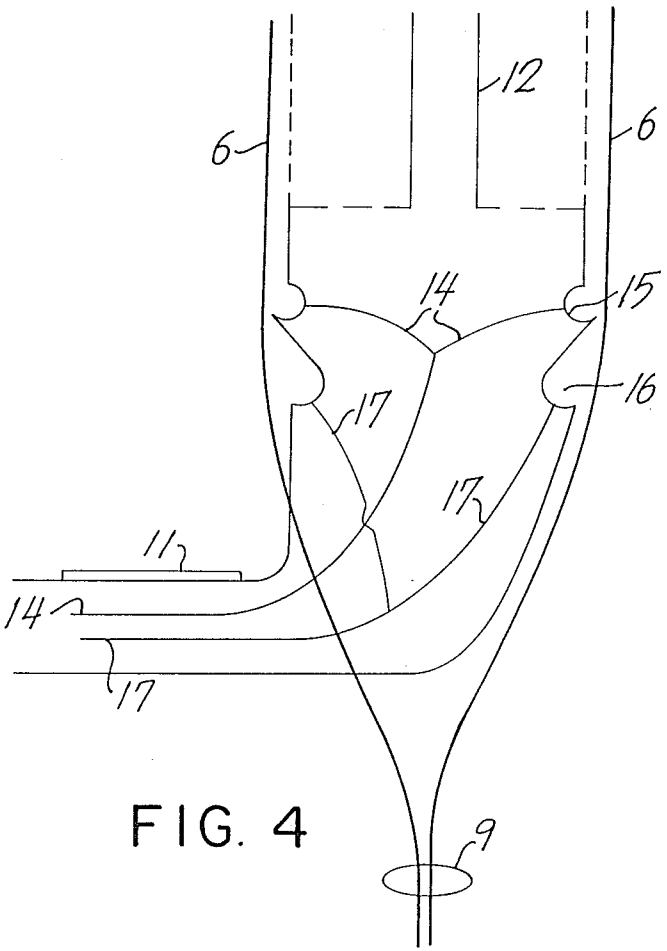
FIG. 4 is an enlarged diagrammatic view of the lower end of FIG. 1.

Dispersing head 5 is also provided with coating device 7. As is best shown in FIG. 4, this device consists of liquid inlet 14 which connects with applicator 15. The latter is in the form of a circular channel surrounding the lower portion of dispersing head 5. Filaments 6, as they are being drawn through filament guide 9, contact applicator 15 and are coated thereby. Excess coating liquid is caught by collector 16, passes through liquid return 17, and is conveyed thereby out of the device. The coating liquid is normally a conditioner for filaments 6, but could be any liquid with which it is desired to coat the filaments.

Since coolant inlet 8 passes substantially perpendicularly through the stream of filaments 6, it has been found desirable, in a preferred form of the device, that the cross-section of coolant inlet 8 taken perpendicular to its axis be narrow in the horizontal direction and long in the vertical direction, both as shown in FIG. 1. This minimizes the area which would otherwise impede the flow of filaments 6. In a preferred form of the invention, filament deflector 11 is provided at the upstream side of inlet 8. This can advantageously be a ceramic coating or a ceramic element (e.g. a rod or half-shell) to avoid any tendency of filaments 6 to adhere to inlet 8.

Figure 2:
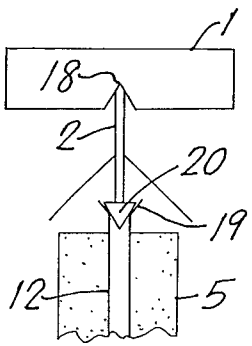
FIG. 2 is a diagrammatic view of the upper end of the device, showing the valve in the closed position.
Figure 3:
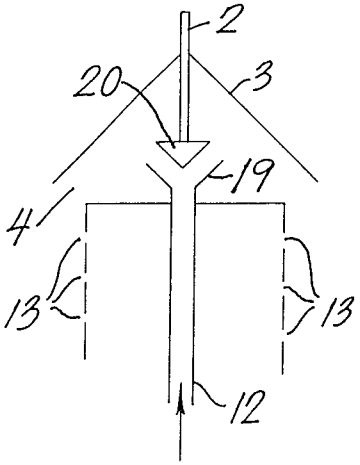
FIG. 3 is an enlarged diagrammatic detail of FIG. 2.

In operation, the melt spinning is first begun without dispersing head 5 in the stream of filaments 6. Head 5 is then pivoted into the stream, and moved parallel to the stream toward nozzle plate 1. A relatively strong stream of coolant passes through tube 12, valve seat 19, and out circular aperture 4. This stream drives the filaments away from the device as it is being moved upstream and, thereby, minimizes undesired suspension, bonding, and breakage of the filaments. When head 5 is in position, center spike 2 contacts depression 18 in nozzle plate 1. This moves valve closure 20 into the position on valve seat 19 shown in FIG. 2. This cuts off the stream of coolant which had flowed through aperture 4 at the point at which it is no longer needed. Of course, the coolant continues to flow through pores 13 of dispersing head 5.

Similarly, when head 5 is to be removed from the stream of filaments 6 (as, for example, when spinning is to be terminated for any reason), the action is similar. As head 5 is moved away from nozzle plate 1, valve closure 20 separates from valve seat 19. The coolant again flows through aperture 4 and maintains filaments 6 out of contact with any portion of head 5.

The present invention provides a number of important and valuable advantages over the prior art. Since the coolant is introduced from below (in the preferred form of the device), it is possible to use circular nozzles and provide a radially symmetrical melt flow. Moreover, there are no problems with regard to isolation of the nozzles, nor is there any tendency to cool the melt prematurely. Furthermore, a device of the character set forth can be retro-fitted without changing the spinning beam.

The head of the present invention can be swiveled perpendicularly to the stream of filaments into and out of the filament path. In addition, it is capable of movement parallel to the flow of filaments, both toward and away from the nozzle plate. This assists in introducing the head into the filament stream with a minimum of disruption of the filaments.

As the device is introduced, after spinning has begun, the strong coolant stream emerges from the circular aperture at the upstream end of the device. This forces the filaments away from the head and substantially avoids supension, bonding, and breakage of the filaments. As the head is moved upstream to its proper position for spinning, the central spike is urged downstream by the underside of the nozzle plate. This closes the valve at the top of the tube and cuts off the strong flow of coolant when it is no longer needed. When the head is being withdrawn from the stream of filaments, the action is similar. Again, the strong coolant flow keeps the filaments away from the head until it is swiveled out of the filament stream.

Unlike the prior art, it is not necessary to divide the filaments into two bundles. The coolant stream is not introduced through a round tube, but through a flat channel. This presents a relatively small area to the filament stream, while it is relatively long in the direction of the filament stream. The provision of a filament deflector (usually ceramic) on the upstream side of the channel aids in preventing undesirable adhesion and/or disruption of the filament flow.

It is also a feature of the present invention that the coating of the filaments takes place at the lower end of the head, but above the pivotable air inlet. As the coating solution is conventionally a conditioner (which is about 99% water), it can readily be applied and the excess liquid collected and returned to the source thereof. The location of the coating means is important since the coating takes place while the filaments are loose and not spun into a cable strand. This aids in permitting the filaments to pass smoothly over the coolant inlet and also provides an opportunity for a portion of the liquid to evaporate before the filaments are compressed in the filament guide. Among other things, this evaporation aids in the cooling of the filaments.

The collector receives the excess coating liquid and conveys it via the liquid return to the source thereof. It should also be noted that both the liquid inlet and liquid return are located within the coolant inlet. By doing so, interference with the filament stream is further minimized.

A liquid coating device for melt-spun filaments is shown in U.S. Pat. No. 4,038,357. However, that device teaches 1-sided, asymmetric filament cooling using a thin liquid film. It is the intention of the device to prepare latently crimpable filaments. There is a centered metal shaped part having a relatively broad contact surface. The friction which inevitably accompanies the use of such a surface increases the filament tension to an unacceptable degree in the conventional spinning process. This is especially true if take off speeds are used which are substantially above the maximums set forth in the examples of the patent; i.e. about 900 m/min or 3,000 ft. per minute.

It should be recognized that the circular applicator and collector of the present invention are not the only forms of coating device which are contemplated. More specifically, these elements can be broadened and filled with a material which will act as a wick. Alternatively, the contact surface can be replaced by a narrow sintered metal ring.

In order to illustrate the present invention, the following specific examples are set forth.

EXAMPLE 1

A polyethylene terephthalate granulate, having a relative solution viscosity of 1.60 (measured as a 1.0% solution in m-cresol at 20° C.), was melted in a 90 mm/24D spin extruder and spun at a melt temperature of 293° C. A throughput of 996 g/min was effected through a round nozzle having 1,295 round passages arranged in nine circles. The diameter of the passages was 0.4 mm.

The filaments were cooled by the device of the present invention, located substantially in the center of the filament stream. The dispersing head used 450 kg/h air at 30° C. and 65% relative humidity. The head itself had an inside diameter of 70 mm and an outside diameter of 76 mm. Its length was 530 mm and its cover height was 30 mm. The ratio of air to melt throughput was 7.5 to 10.0.

At the end of the air stream, the filaments pass through the coating device at which point a conditioner was applied thereto. The applicator had a diameter of 180 mm and 400 ml/min of a 0.5% solution of spinning conditioning agent was applied. The filaments were then brought together in the filament guide, drawn off over galettes at 1,500 m/min and, thereafter, wound on reels in spinning canisters.

The spun cable was stretched on the fiber path in a ratio of 1 to 3.5; it was then fixed, compress-crimped, dried, and cut to give staple fibers 38 mm long. When the fibers were tested, it was found that they had the following properties. Titre: 1.53 dtex, break resistance: 6.4 cN/dtex, strength at 7% elongation: 2.2 cN/dtex, and elongation at break: 20.4%.

It was noted that the spinning process and run-off on the fiber path were substantially free of any unwanted disturbances. The moveable head of the present invention, having the strong air stream at the upstream end, was operated without any difficulty or problems.

EXAMPLES 2 TO 5

The procedure of Example 1 was repeated with the variations and results set forth in the following Table.

TABLE

| | Example | | | |
|---|---|---|---|---|
| | 2 | 3 | 4 | 5 |
| Granulate | PETP | PETP | PETP | PA-6 |
| No. of nozzle holes/diameter | 2158/0.4 | 1661/0.4 | 710/0.4 | 710/0.3 |
| melt throughput, g/min | 1812.2 | 1693 | 1792 | 305 |
| air, kg/h | 770 | 750 | 600 | 390 |
| ratio air/melt throughput | 7.08 | 7.5 | 5.6 | 21.3 |
| dispersing head diameter, mm | 90/96 | 90/96 | 90/96 | 70/74* |
| take-off speed, m/min | 1750 | 770 | 1100 | 1000 |
| stretch ratio, 1: | 3.0 | 4.3 | 4.05 | 2.5 |
| titre, dtex | 1.72 | 2.90 | 5.03 | 1.62 |
| break strength, cN/dtex | 5.8 | 5.4 | 5.7 | 5.7 |
| elongation at break, % | 24.2 | 31.4 | 20.6 | 53.6 |

*head cover heated to 310° C. to prevent PA-6 oligomer deposition.

In all cases, the device of the present invention performed well without any difficulties or problems.

While only a limited number of specific examples have been expressly described, the invention is, nonetheless, to be broadly construed and not to be limited except by the character of the claims appended hereto.

What we claim is:

1. In an apparatus for spinning filaments from a melt, the improvement which comprises a nozzle plate having a plurality of arranged passages in the generally annular pattern adapted to permit said melt to flow therethrough to form a stream of said filaments, a dispersing head downstream of said plate and in said stream, said head being substantially in a form of a cylinder with its axis substantially parallel to said stream and having an upstream end and a downstream end, a coolant souce, a coolant inlet connecting said coolant source with said head at a point, a wall of said head substantially parallel to said stream being porous, whereby coolant passes through said wall and impinges on said filaments, said upstream end is provided with a circular aperture, a tube from said point to said aperture, whereby a substantial amount of coolant is expelled through said aperture.

2. The apparatus of claim 1 wherein said passages are arranged concentrically.

3. The apparatus of claim 2 wherein said passages are in a circular array.

4. The apparatus of claim 1 wherein said head is substantially surrounded by said filaments.

5. The apparatus of claim 1 wherein said coolant is a gas.

6. The apparatus of claim 5 wherein said coolant is air.

7. The apparatus of claim 1 wherein said coolant inlet is connected to said head adjacent or at said downstream end and said coolant flows countercurrently to said stream.

8. The apparatus of claim 1 wherein said aperture is directed radially outwardly and downwardly.

9. The apparatus of claim 1 wherein a valve is provided which cooperates with said tube and is adapted to close said tube and prevent coolant from flowing therethrough.

10. The apparatus of claim 9 wherein said valve comprises a center spike on said upstream end of said cylinder and projecting therefrom, a seat at the upstream end of said tube, a closure on the downstream end of said spike complementary to said seat and adapted to seal thereagainst.

11. The apparatus of claim 10 comprising means for moving said head parallel to said stream between a first position remote from said plate and a second position adjacent said plate whereby, when said head is in said second position, said plate exerts pressure on said spike to close said valve.

12. The apparatus of claim 1 wherein said coolant inlet is at an angle other than 0° or 180° to said stream.

13. The apparatus of claim 1 wherein said coolant inlet is relatively narrow in a direction perpendicular to said stream and relatively wide in a direction parallel to said stream.

14. The apparatus of claim 1 wherein said coolant inlet is provided with a filament deflector on its upstream portion.

15. The apparatus of claim 1 where said head has a heating means at or adjacent its upstream end.

16. The apparatus of claim 11 wherein said plate has a recess into which the upstream end of said spike fits when said head is in said second position.

17. The apparatus of claim 1 wherein said head is sintered metal, a filter web, or reinforced filter fleece.

18. The apparatus of claim 1 wherein said upstream end of said head is tapered in an upstream direction.

19. The apparatus of claim 12 wherein said angle is approximately 90°.

20. In an apparatus for spinning filaments from a melt, the improvement which comprises a nozzle plate having a plurality of arranged passages in a generally annular pattern adapted to permit said melt to flow therethrough to form a stream of said filaments, a dispersing head downstream of said plate and in said stream, said head being substantially in a form of a cylinder with its axis substantially parallel to said stream and having an upstream end and a downstream end, a coolant source, a coolant inlet connecting said coolant source with said head at a point, a wall of said head substantially parallel to said stream being porous, whereby coolant passes through said wall and impinges on said filaments, an applicator downstream of said head comprising at least one peripheral channel adapted to be contacted by said filaments, a source of coating liquid, a liquid inlet connecting said source of coating liquid with said peripheral channel, whereby said filaments are coated with said liquid.

21. The apparatus of claim 20 having a collector downstream of said applicator comprising a return channel adapted to receive overflow from said applicator, a liquid return from said return channel, whereby excess liquid is conveyed away from said stream.

22. The apparatus of claim 21 wherein said liquid inlet and said liquid return are at least partially located in said coolant inlet.

23. The apparatus of claim 21 wherein there is a filament guide downstream of said collector.

24. The apparatus of claim 20 wherein said liquid is a conditioning agent or water.

25. The apparatus of claim 24 wherein said conditioning agent is a spinning oil or a finishing oil.

26. In an apparatus for spinning filaments from a melt, the improvement which comprises a nozzle plate having a plurality of arranged passages in a generally annular pattern adapted to permit said melt to flow therethrough to form a stream of said filaments, a dispersing head downstream of said plate and in said stream, said head being substantially in a form of a cylinder with its axis substantially parallel to said stream and having an upstream end and a downstream end, a coolant source, a coolant inlet connecting said coolant source with said head at a point, a wall of said head substantially parallel to said stream being porous, whereby coolant passes through said wall and impinges on said filaments, said head having means for moving said head into and out of said stream during said flow.

27. The apparatus of claim 26 further comprising means for moving said head parallel to said stream toward and away from said plate.

28. The apparatus of claim 26 further comprising means for moving said head parallel to said stream toward and away from said plate during said flow.

29. In an apparatus for spinning filaments from a melt, the improvement which comprises a nozzle plate having a plurality of arranged passages in a generally annular pattern adapted to permit said melt to flow therethrough to form a stream of said filaments, a dispersing head downstream of said plate and in said stream, said head being substantially in a form of a cylinder with its axis substantially parallel to said stream and having an upstream end and a downstream end, a coolant source, a coolant inlet connecting said coolant source with said head at a point, a wall of said head substantially parallel to said stream being porous, whereby coolant passes through said wall and impinges on said filaments, and means for moving said head parallel to said stream toward and away from said plate.

30. The apparatus of claim 29 wherein there is provided a means for moving said head toward and away from a central longitudinal axis of said stream.

31. The apparatus of claim 29 wherein said means is for moving said head parallel to said stream toward and away from said plate during said flow.

* * * * *